US005152196A

United States Patent [19]

Garrett

[11] Patent Number: 5,152,196

[45] Date of Patent: Oct. 6, 1992

[54] RATCHET WRENCH HAVING AUXILIARY RATCHETING MECHANISM

[76] Inventor: Ronald L. Garrett, 4529 Pitt St., Anderson, Ind. 46013

[21] Appl. No.: 795,473

[22] Filed: Nov. 21, 1991

[51] Int. Cl.[5] ..... B25B 13/46

[52] U.S. Cl. ..... 81/58.1

[58] Field of Search ..... 81/58.1, 60-63.2

[56] References Cited

U.S. PATENT DOCUMENTS

| | | | |
|---|---|---|---|
| 1,601,767 | 7/1923 | Peterson . | |
| 2,393,413 | 7/1943 | Rober | 81/58 |
| 2,523,041 | 3/1948 | McKenzie . | |
| 2,620,001 | 3/1950 | Fratz et al. . | |
| 2,621,688 | 1/1956 | Wales . | |
| 3,184,998 | 7/1963 | Young | 81/52.3 |
| 3,306,141 | 11/1965 | Hall et al. | 81/177 |
| 3,343,577 | 8/1966 | Wagner . | |
| 3,575,069 | 4/1971 | White | 81/58.1 |
| 3,957,096 | 5/1976 | Rodman . | |
| 4,054,067 | 10/1977 | Blank | 81/58.1 |
| 4,356,852 | 11/1982 | Smith . | |
| 4,747,328 | 5/1988 | Howard | 81/54 |
| 5,005,446 | 4/1991 | Main | 81/63 |

*Primary Examiner*—D. S. Meislin

*Attorney, Agent, or Firm*—Shook, Hardy & Bacon

[57] ABSTRACT

A ratchet wrench having a primary ratchet mechanism is provided with an auxiliary ratcheting device that is of a knob-like configuration. The auxiliary ratchet allows the wrench to be used to tighten a nut on a bolt in situations where reciprocation of the wrench handle is impeded. The auxiliary ratchet also has a lower ratcheting resistance than the primary mechanism to allow a loose nut to be tightened by ratcheting of the auxiliary device in instances where reciprocation of the wrench handle would cause back and forth movement of the nut.

13 Claims, 1 Drawing Sheet

RATCHET WRENCH HAVING AUXILIARY RATCHETING MECHANISM

BACKGROUND OF THE INVENTION

This invention relates generally to ratchet wrenches and, more particularly, to a ratchet wrench having an auxiliary ratcheting mechanism.

Ratchet wrenches are well known and provide for quick removal or tightening of nuts and bolts by back and forth movement of the ratchet handle. Such wrenches typically have an internal ratchet wheel and a pawl which directionally engages the teeth of the wheel to lock the wheel when the wrench is turned in one direction. The pawl then releases to permit rotation of the wheel when the wrench in turned in the other direction during the backstroke. This ratcheting action allows the nut or bolt to be tightened by a socket coupled with the ratchet wheel without requiring removal of the socket from the nut or bolt during the backstroke.

Often during the tightening or removal of bolts or nuts, the ratchet handle may only be rotated a slight amount because of obstructions which prevent the handle from being moved through the desired range of motion. If the handle cannot be rotated sufficiently to operate the internal ratcheting mechanism, an extension device must then be used to provide the necessary operating clearance. This results in delays while the extender is located and then applied to the wrench. Even if some degree of ratcheting can be achieved, the limited range of movement of the handle significantly delays the tightening or loosening process.

Another problem frequently encountered during the tightening or loosening of a nut on a bolt is that the nut is so loose that back and forth reciprocation of the handle merely turns the nut back and forth on the bolt. This occurs when the internal ratcheting resistance of the wrench is greater than the force required to loosen the nut. In other words, the force required to advance the pawl to successive teeth on the ratchet wheel is greater than the force required to turn the nut The user must then hold the socket on the backstroke to effect the ratcheting action or the socket must be removed from the bolt head or nut during the backstroke. Either remedy is inconvenient and adds additional time to the tightening process.

SUMMARY OF THE INVENTION

It is an object of this invention to provide a ratchet wrench having an auxiliary ratcheting device operable independently of the wrench handle so that ratcheting action can be readily achieved even in confined areas where the desired range of motion of the handle is impeded.

It is another object of this invention to provide a ratchet wrench with an auxiliary ratcheting device which can be operated even in confined areas independently of the wrench handle but which is directly connected to the drive and socket so that the user can readily switch between use of the handle and auxiliary device by simply shifting the user's hand position on the wrench and without requiring removal of the socket from the wrench.

It is also an object of this invention to provide a ratchet wrench with an auxiliary ratcheting device having an internal ratcheting resistance which is less than that of the primary ratcheting mechanism of the wrench so that the auxiliary device may be used with a ratcheting action even in situations where the nut or bolt being turned is too loose to cause ratcheting of the primary ratchet mechanism.

To accomplish these and other related objects of the invention, a ratchet is provided comprising:

an elongated handle;

a first ratchet mechanism coupled with the handle;

a drive connected to the first ratchet mechanism and being configured for releasably holding a socket, said first ratchet mechanism being reversibly operable to transmit torque to the drive about an axis of rotation in response to movement of the handle about said axis in one direction and to permit relative rotation between the handle and drive in response to movement of the handle about said axis in the opposite direction;

a second ratchet mechanism coupled with the drive and including a body portion, said second ratchet mechanism being selectively engageable to transmit torque to the drive in response to movement of the body portion in one rotative direction and releasable to permit relative rotation between the body portion and the drive in response to rotative movement of the body portion in the opposite direction, whereby said second ratchet mechanism may transmit torque to the drive independently of the handle.

In another aspect, the invention relates to the provision of different ratcheting resistances in the first and second ratchet mechanisms so that the force required to cause ratcheting of the second mechanism on the backstroke of the body portion is less than the force required to cause ratcheting of the first mechanism on the backstroke of the handle. This allows the second mechanism to be ratcheted even when a bolt or nut being driven is too loose to cause ratcheting of the first mechanism.

BRIEF DESCRIPTION OF THE DRAWING

In the accompanying drawings which form a part of the specification and are to be read in conjunction therewith and in which like reference numerals are used to indicate like parts in the various views.

DESCRIPTION OF THE PREFERRED EMBODIMENT

Figure 1:
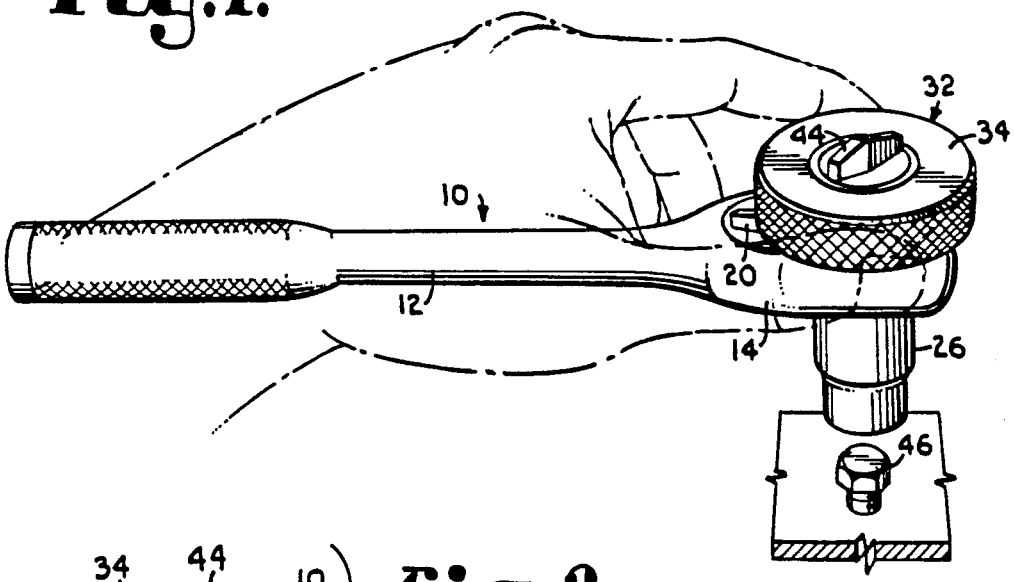
FIG. 1 is a side perspective view of a ratchet wrench in accordance with the present invention and showing in phantom lines a user's hand positioned for operation of the auxiliary ratchet mechanism.
Figure 2:
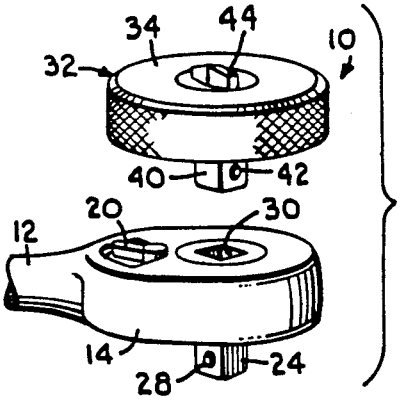
FIG. 2 is a fragmentary exploded side perspective view showing the auxiliary ratchet mechanism removed from the head portion of the ratchet wrench.
Figure 3:
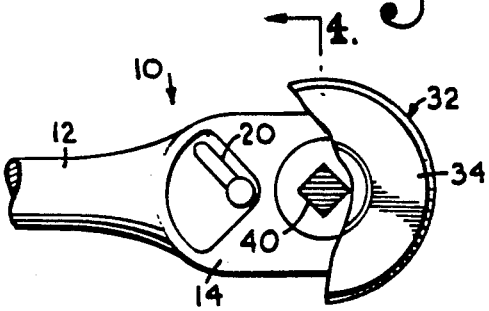
FIG. 3 is a fragmentary top plan view of the ratchet wrench with a portion of the auxiliary ratchet mechanism broken away to show seating of the drive projection within the primary ratcheting mechanism.
Figure 4:
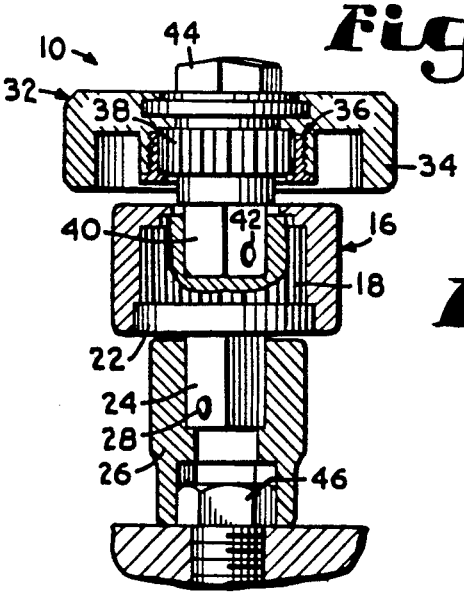
FIG. 4 is a vertical section view of the wrench taken along line 4—4 of FIG. 3 in the direction of the arrows and shown on an enlarged scale and with a portion broken away for purposes of illustration and shown positioned on a bolt head.
Figure 5:
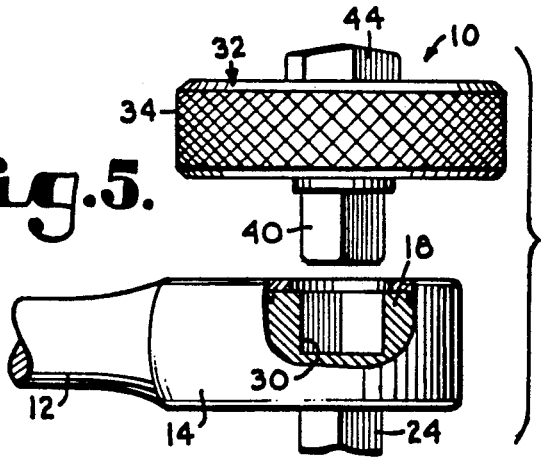
FIG. 5 is an exploded side elevational of the ratchet wrench shown on the scale of FIG. 4 and with portions broken away for purposes of illustration and with the handle shown fragmentally.

Referring now to the drawings in greater detail, a preferred embodiment of the ratchet wrench of the present invention is represented broadly by the numeral 10. Wrench 10 comprises an elongated handle 12 and an attached head portion 14 which houses a primary ratchet mechanism 16 having a toothed wheel 18 and a single- or double-acting pawl (not shown) that operate in a generally conventional fashion. A lever 20 is provided for switching the ratchet direction of mechanism 16.

The toothed wheel 18 is held within the head portion 14 of the wrench 10 by a retaining ring 22. A square-shaped drive projection 24 is connected to the wheel 18 and extends through ring 22 for releasably receiving a socket 26. A ball detent 28 on the projection 24 serves to tightly retain the socket on the projection. The wheel 18 also includes a recess 30 which is square in cross-section and of a depth to receive a drive projection of a conventional ratchet wrench or an auxiliary ratchet device 32 as will be subsequently described.

Auxiliary ratchet device 32 comprises a knob-like cylindrical body portion 34 that houses an internal ratcheting mechanism 36. The diameter of body portion 34 is preferably at least slightly greater than that of the underlying head portion 14 to permit the turning of the body portion by movement of the user's thumb and/or forefinger while grasping the wrench handle 12 with the remaining fingers as shown in FIG. 1. The mechanism 36 is similar to the ratchet mechanism 16 previously described and includes a toothed wheel 38 and a single- or double-acting pawl (not shown). A drive projection 40 having a ball detent 42 is connected to the toothed wheel 38 and is sized and configured for insertion into the recess 30 in the wheel 18 of the primary ratchet mechanism 16. A finger-actuable lever 44 is connected to the internal pawl and may be moved between two positions to control the ratcheting direction of the auxiliary ratchet device 32.

Auxiliary ratcheting mechanism 36 is preferably constructed to have an internal ratcheting resistance which is less than that of primary mechanism !6. In other words, the force required to move the pawl to successive teeth on wheel 38 is less than the force required to similarly move the pawl in ratcheting mechanism 16. This difference in ratcheting resistances permits ratcheting of the auxiliary device 32 even when the nut or bolt head being driven is too loose to result in ratcheting of the primary ratchet mechanism 16.

It will be appreciated that many types of conventional ratcheting mechanism are known and can be used for ratchet mechanisms 16 and 36. The novelty of the present invention is seen to partly reside in the ganging of these ratchet mechanisms in a manner so that the auxiliary ratchet device 32 directly drives the socket 26. This permits the user to tighten a bolt head 46 or nut either by reciprocating movement of the wrench handle 12 or by grasping the handle as shown in FIG. 1 and using the thumb and/or forefinger to turn the auxiliary ratchet device 32. The ability to select between these tightening methods without removing the socket 26 from the bolt head or nut is particularly important in those situations where swinging movement of the wrench handle 12 is partially impeded. In such an instance, the user may rely upon the auxiliary ratchet device 32 for the initial tightening of the bolt head or nut. This permits the bolt to be tightened more quickly than by swinging of the handle 12 through a limited arc. The handle 12 may then be used to apply greater leverage to securely tighten the bolt head or nut once it has been initially tightened by auxiliary ratchet device 32. It can be seen that the same advantages are obtained when loosening of the bolt head or nut is desired. The ability to utilize both the handle 12 and auxiliary device 32 for tightening or loosening purposes by slightly altering the hand position on the wrench 10 and without requiring removal of the socket 26 from the wrench or the bolt head is a distinct advantage over conventional devices.

The present invention also resides in the provision of different ratcheting resistances in mechanisms 16 and 36. This difference in ratcheting resistance is particularly advantageous in those situations where the bolt head 46 or nut is so loose that back and forth reciprocation of the handle merely turns the nut back and forth because the internal ratcheting resistance of mechanism 16 has not been overcome In other words, the force required to advance the pawl to the next tooth on the wheel 18 is greater than the resistance to movement of the bolt or nut in the same rotative direction. In such circumstances, the operator must normally place his other hand on the socket during the backstroke of the handle to operate the ratchet This may be inconvenient or impossible when access to the bolt is restricted or when the other hand is being used to hold a backup wrench or is otherwise engaged. The auxiliary ratchet device 32 addresses this problem by providing an internal ratcheting resistance lower than that of mechanism 16 and sufficiently low to permit ratcheting even if the bolt head or nut is very loose. The user may thus use the ratcheting feature of the auxiliary device 32 to quickly start the nut on the bolt and then switch to use of handle 12 once the turning resistance of the nut exceeds that of ratchet mechanism 16. The ganging of the auxiliary device 32 directly to the drive of the ratchet mechanism 16 allows the transition between use of device 32 and handle 12 to be a simple matter of slightly altering the hand position on the wrench 10 and does not require the time consuming switching of the socket 26 between devices or removal of the socket from the bolt head.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A ratchet comprising:

an elongated handle;

a first ratchet mechanism coupled with the handle;

a drive connected to the first ratchet mechanism and being configured for releasably holding a socket, said first ratchet mechanism being reversibly operable to transmit torque to the drive about an axis of rotation in response to movement of the handle about said axis in one direction and to permit relative rotation between the handle and drive in response to movement of the handle about said axis in the opposite direction, said first ratchet mechanism having a resistance to said relative rotation between the handle and drive; and a second ratchet mechanism coupled with the drive and including a body portion, said second ratchet mechanism being selectively engageable to transmit torque to the drive in response to movement of the body portion in one rotative direction and releasable to permit relative rotation between the body portion and the drive in response to rotative movement of the body portion in the opposite direction, whereby said second ratchet mechanism may transmit torque to the drive independently to the handle, said second ratcheting mechanism having a resistance to said relative rotation between the body portion and drive which is less than the resistance of said first ratcheting mechanism.

2. The ratchet of claim 1, including a recess within the first ratchet mechanism and wherein the second ratchet mechanism includes a projection for releasable insertion in the recess.

3. The ratchet of claim 2, wherein the first ratchet mechanism includes a ratchet wheel connected to the drive and wherein the recess is located in the ratchet wheel.

4. The ratchet of claim 3, wherein the first ratchet mechanism includes a pawl selectively engaging the ratchet wheel to transmit said torque from the handle to the drive in response to said movement of the handle in the rotative direction.

5. The ratchet of claim 4, wherein said pawl releases said ratchet wheel when the handle is moved in said opposite direction, thereby permitting movement of the ratchet wheel and said rotation of the handle about the drive.

6. The ratchet of claim 5, wherein said body portion of the second ratchet mechanism is knob-like and is positioned for rotation by a user's thumb while grasping said handle with the fingers on the same hand as said thumb.

7. A ratchet wrench comprising:

a handle;

a drive for releasably holding a socket and mounted for rotation about an axis;

a first ratchet mechanism coupling said handle with said drive and reversibly operable to cause rotation of the drive in response to rotation of the handle about said axis in one direction and permitting relative rotation between the drive and the handle about said axis in response to rotation of the handle in an opposite direction, said mechanism having a resistance which must be overcome to permit said relative rotation between the drive and handle; and a second ratchet mechanism coupled with the drive and having a body portion, said second ratchet mechanism being reversibly operable to cause rotation of the drive in response to rotation of the body portion about said axis in said one direction and permitting relative rotation between the drive and the body portion about said axis in response to rotation of the body portion in the opposite direction, said second ratchet mechanism having a resistance which must be overcome to permit said relative rotation between the drive and the body portion, said resistance of the second ratchet mechanism being less than said resistance of the first ratchet mechanism.

8. The ratchet of claim 7, including a recess within the first ratchet mechanism and wherein the second ratchet mechanism includes a projection for releasable insertion in the recess.

9. The ratchet of claim 8, wherein the first ratchet mechanism includes a ratchet wheel connected to the drive and wherein the recess is located in the ratchet wheel.

10. The ratchet of claim 9, wherein the first ratchet mechanism includes a pawl selectively engaging the ratchet wheel to transmit said torque from the handle to the drive in response to said movement of the handle in the rotative direction.

11. The ratchet of claim 10, wherein said pawl releases said ratchet wheel when the handle is moved in said opposite direction, thereby permitting movement of the ratchet wheel and said relative rotation of the handle and the drive.

12. The ratchet of claim 11, wherein said body portion of the second ratchet mechanism is knob-like and is positioned for rotation by a user's thumb while grasping said handle with the fingers on the same hand as said thumb.

13. The ratchet of claim 12, wherein said handle is elongated.

* * * * *